US005513081A

United States Patent [19]

Byers

[11] Patent Number: 5,513,081

[45] Date of Patent: Apr. 30, 1996

[54] MULTIPLE LIGHT INSTALLATION AND STORAGE SYSTEM

[76] Inventor: Thomas L. Byers, 5480 Stewart Dr., Mustang, Okla. 73064

[21] Appl. No.: 429,895

[22] Filed: Apr. 27, 1995

[51] Int. Cl.[6] ..... F21V 21/08

[52] U.S. Cl. ..... 362/145; 362/249; 362/806; 362/431; 362/396; 362/252; 206/419; 206/420

[58] Field of Search ..... 362/249, 252, 362/387, 396, 391, 806, 145, 389, 234, 226, 432, 147, 151, 152; 248/314, 223.4; 439/419, 533, 573, 532, 540, 569, 570, 571; 206/419, 420, 421

[56] References Cited

U.S. PATENT DOCUMENTS

| | | | |
|---|---|---|---|
| 2,889,451 | 6/1959 | Longo | 362/396 X |
| 3,189,310 | 6/1965 | Trueson | 248/314 |
| 3,204,090 | 8/1965 | Kvarda, Jr. | 240/10 |
| 3,384,227 | 5/1968 | Spatz | 206/65 |
| 3,404,268 | 10/1968 | Fowler | 240/10 |
| 3,540,687 | 11/1970 | Cuva | 248/316 |
| 4,128,863 | 12/1978 | Premetz | 362/249 |
| 4,357,653 | 11/1982 | Kovacs | 362/806 X |
| 4,491,902 | 1/1985 | Cangolosi | 362/389 |
| 4,769,749 | 9/1988 | Folski | 362/806 X |
| 5,024,406 | 6/1991 | Ketcham | 248/149 |
| 5,033,619 | 7/1991 | Garis | 206/419 |
| 5,036,447 | 7/1991 | Taylor | 362/431 |
| 5,064,067 | 11/1991 | McAllister et al. | 206/420 |
| 5,067,061 | 11/1991 | Prickett | 362/145 |
| 5,110,078 | 5/1992 | Gary | 248/206.2 |
| 5,168,999 | 12/1992 | Lee et al. . | |
| 5,238,425 | 8/1993 | Klicwer | 362/249 X |
| 5,297,013 | 3/1994 | Hall et al. | 362/363 |
| 5,317,491 | 5/1994 | Lee | 362/249 |
| 5,355,288 | 10/1994 | Maddock | 362/806 X |

*Primary Examiner*—Denise L. Gromada
*Assistant Examiner*—Thomas M. Sember
*Attorney, Agent, or Firm*—Dougherty, Hessin, Beavers & Gilbert

[57] ABSTRACT

An installation and storage system for decorative light strings which includes a plurality of track channels for holding successive segments of the light string, such track channels being supportable by snap attachment to pre-positioned snap fasteners, either on a building or in the yard surrounds. A storage rack having opposite end frames and central support is then constructed to receive successive light track channels in snap-fit for carriage and storage.

20 Claims, 6 Drawing Sheets

MULTIPLE LIGHT INSTALLATION AND STORAGE SYSTEM

BACKGROUND OF THE INVENTION

1. Field of the Invention

The invention relates generally to multiple light strings and, more particularly, but not by way of limitation, it relates to improved apparatus for installation of Christmas lights wherein the light strings are readily received on a carrier apparatus for transportation and storage.

2. Description of the Prior Art

There is a great amount of prior art extending back over a long period of time that relates to light strings and apparatus for mounting various types of light strings in both indoor and outdoor decorative displays. An early U.S. Pat. No. 3,189,310 discloses an outside light holder for Christmas lights that consists of a cylindrical holder that may be fastened to a building roof or facia location to hold an individual Christmas light socket. Thus a plurality of such cylindrical socket supports are secured along the designated display sight at the requisite spacing to hold each individual lamp of the light string. U.S. Pat. No. 3,204,090 shows another early form of light string support wherein a channel member is adapted for mounting of a string of spaced Christmas lights, and the channel member is fitted with a hook edge for the purpose of suspending the channel from the front of residential guttering thereby to display a light pattern along the roof eave line. U.S. Pat. No. 3,540,687 discloses an individual light socket retaining means which consists of a base element for mounting to a house or similar structure to be coupled with a clip-type light socket holder that is attachable to the base element. For mounting a string of Christmas lights, a plurality of such base element/clip-holders must be attached to the residential structure to outline the lighting pattern as a base/holder is required for each individual lamp socket.

U.S. Pat. No. 3,384,227 provides teaching of a storage container for a string of lights such as Christmas lights wherein the storage container holds the lights serially in stored array such that the light string may be removed from the end of the container one bulb at a time for stringing and placement on a tree or other situs. A recent U.S. Pat. No. 5,064,067 teaches a Christmas light organizer that consists of a rectangular frame having a plurality of tooth-like projections along each edge which allow the string of lights to be wound around the frame and through successive adjacent projections along the edges of the frame. A pre-examination patent search of the related art disclosed still other teachings of general interest only, and none of the prior art teaches anything approaching the particular light strip apparatus, nor the storage apparatus, nor the general combination.

SUMMARY OF THE INVENTION

The present invention relates to an improved type of Christmas tree light installation and a transportation and storage assembly for receiving the light apparatus. The multiple electric light strings are designed for insertion and seizure along a light track channel of designated length. The track channel also includes a snap channel disposed centrally along the bottom of the track channel for pressure fixture to a molded snap button that may be permanently secured to a mounting site such as a residential roof or facia. Several alternative designs are included herein. A multiple of such track channels with light strings attached may be stored on a storage rack consisting of opposite end frames secured together by support tubes so that each end frame projects opposite side rails having plural lug pairs formed vertically therealong; whereupon, it is only necessary to secure the track channels in serial formation along adjacent lug pairs so that the storage rack with light strings may be carried and stored within a compact space.

Therefore, it is an object of the present invention to provide a mounting track channel carrying a multiple of light bulbs that may be releasibly positioned on permanently disposed snap buttons.

It is also an object of the present invention to provide a storage rack where a multiple of individual track channels with light strings may be easily carried and stored when not in seasonal use.

It is yet further an object of the invention to provide a storage rack for compact and space-saving storage of a multiple of decorative light strips.

Finally, it is an object of the present invention to provide multi-light track channels and storage racks that are sturdy yet light in weight.

Other objects and advantages of the invention will be evident from the following detailed description when read in conjunction with the accompanying drawings that illustrate the invention.

BRIEF DESCRIPTION OF THE DRAWINGS

FIG. 6 is a side quarter perspective view of a storage rack constructed in accordance with the invention;

DETAILED DESCRIPTION OF THE INVENTION

Figure 1:
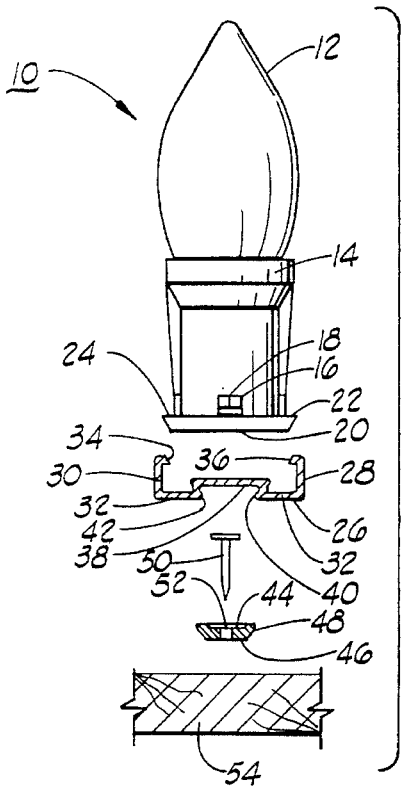
FIG. 1 is a side view in elevation in exploded form with parts shown in section of a Christmas light socket, track channel, molded snap button and mounting situs.
Figure 2:
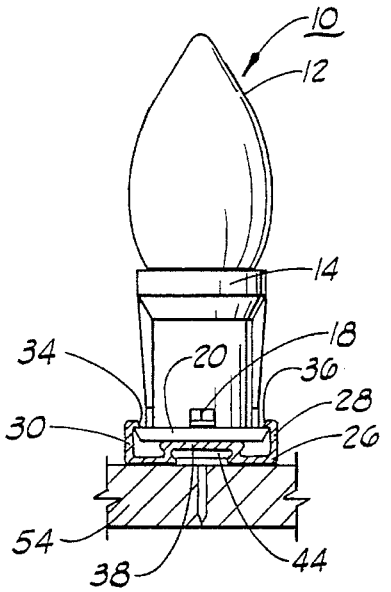
FIG. 2 is a view in side elevation of the FIG. 1 items when assembled into operative position.

Referring to FIG. 1, a standard Christmas light string 10 would consist of a plurality of standard outdoor Christmas bulbs 12 each seated in such as a molded plastic socket 14. The sockets 14 may be of many variations but they are generally of a cylindrical shape having a feed-through 16 at or near the bottom which allows passage of a multi-wire cable, e.g., two wire pair, 18 to pass therethrough. In most conventional assemblies, the two wire pair passes through the base of socket 14 and piercing tines connect the wire pairs of cable 18 to respective contacts within socket 14.

A base flange 20 is added to the bottom of each of the sockets 14 of the light string. In the case of original manufacture, the base flange 20 would be included with the molded socket 14 to extend opposing corners 22 and 24 outward in predetermined extension. In some cases it may be necessary to adapt existing light sockets whereupon suitable disks forming base flange 20 may be bonded to the bottom of respective light sockets 14. In either case, the outboard corners 22 and 24 provide a gripping surface for the track channel 26.

Track channel 26 is an extruded plastic or thin metal which is formed to have opposite side rails 28 and 30 extending at right angles from a base panel 32. The upper edges of side rails 28 and 30 each terminate with inward extending flanges 34 and 36 which provide gripping retention when positioned on flanges 22 and 24 of base flange 20. The track channel 26 also includes a longitudinal, central snap channel 38 formed upward through channel base 32, and it is formed to include opposed channel retention beads 40 and 42 therealong to provide snap gripping, as will be further described.

A molded snap button 44 includes a base portion 46 and a larger radius button portion 48 which provides resilient, secure snap-fit within the longitudinal snap channel 38 of track channel 26. A suitable galvanized nail 50 or other fastener may be used to secure the snap button 44 through hole 52 into the selected situs member 54 which may be a building roof, facia or other structure about the building. The track channel 26 would normally be selected to be of a multiple of feet in length to contain a multiple of light sockets 14 and the respective light bulbs 12, as will be further described below. It should be noted, however, that only two snap buttons 44 need be mounted to provide secure positioning of the track channel 26.

Figure 3:
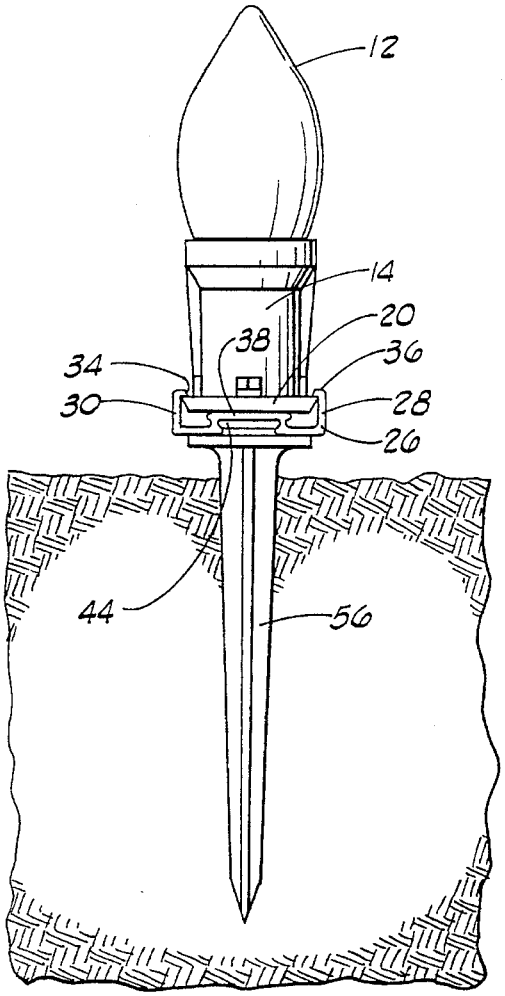
FIG. 3 is a view in side elevation showing alternative mounting on a yard stake.

An alternative mounting arrangement would be to use yard stakes such as shown in FIG. 3. A plurality of spaced yard stakes 56, each having a snap button 44 secured thereon, may be disposed at suitable distances apart on a lawn or garden situs to receive track channels 26 and a multiple of light bulbs 12. Here again, the light string itself includes the base flange 20 on each socket 14 which are seized by opposite side rails 28 and 30 of track channel 26, and the lower snap track 38 secures on the respective snap buttons 44 supported on spaced stakes 56.

Figure 4:
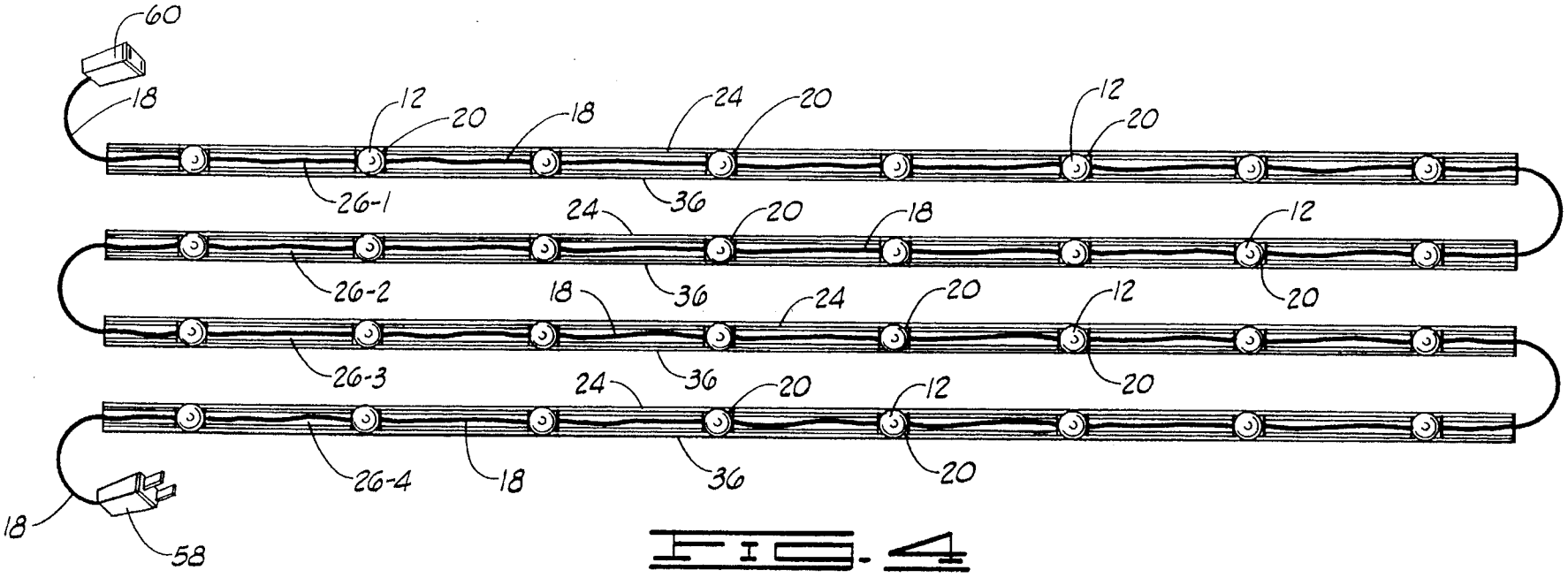
FIG. 4 is a plan view of a thirty-two bulb light string mounted on four track channels.

FIG. 4 illustrates the manner in which a 32-light outdoor light string may be rigged using four six-foot track channels 26-1, 26-2, 26-3 and 26-4. The light string includes a continuous two-wire pair 18 having an A-C plug 58 on one end and a female receptacle 60 on the other end with four eight-bulb light sections mounted on respective track channels 26-1 through 26-4. Each of the track channels 26 includes approximately one-quarter of the length of the wire pair 18 along with eight of the light bulbs 12 as mounted in sockets 14 (FIG. 1) and including base flanges 20. The base flanges 20 may be either round or square (as shown in FIG. 4), and the square type may be preferred since they prevent rotation of the socket 14 relative to track channel 26 when base flange 20 is locked within channel flanges 34 and 36 (FIG. 1).

Figure 5:
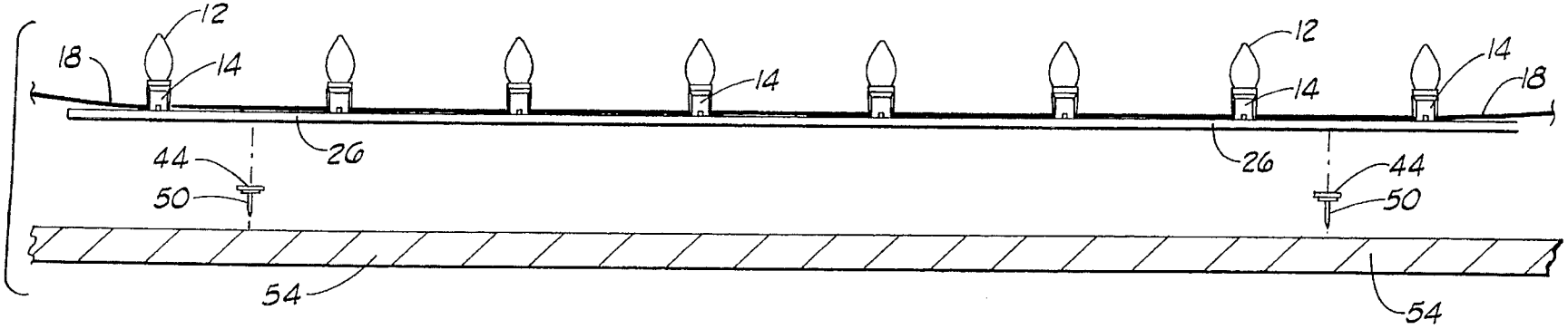
FIG. 5 is a view in side elevation illustrating the manner of mounting a single track channel containing eight bulbs.
Figure 5:
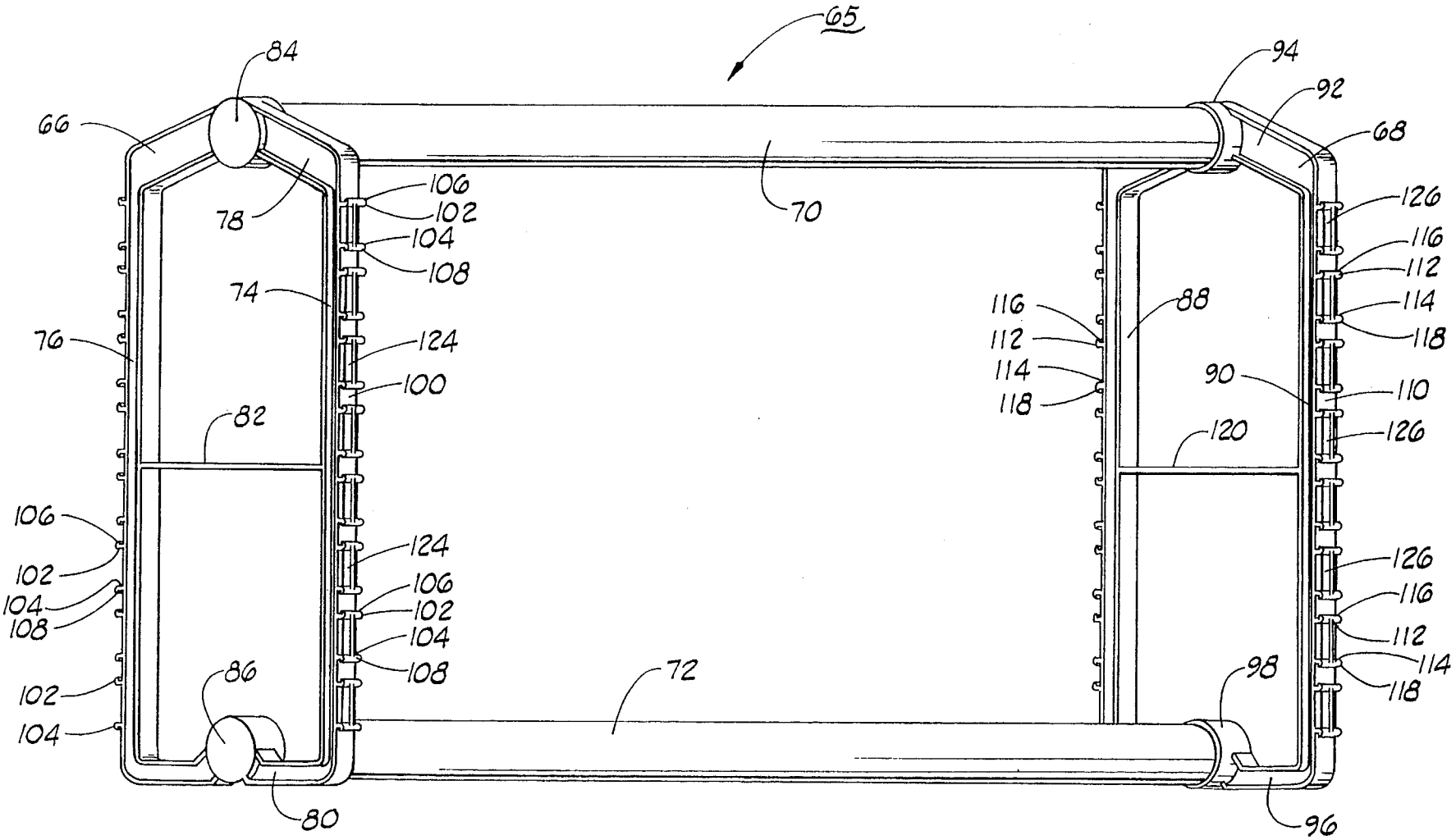

Referring to FIG. 5, each individual section of track channel 26 would support the wire pair 18 and eight light bulbs 12 in equi-spaced distribution therealong. In a typical 32-light string (FIG. 4), each six-foot section of track channel 26 would include eight lamp sockets 14 spaced eight inches apart with opposite end sockets 14 spaced four inches from the ends of track channel 26. Thus, the snap buttons 44 with fasteners 50 would be secured into the building structure 54 at the designated location at about four to five foot spacing to receive secure affixture of the track channel 26 when installed. Should it be preferred to employ lawn or garden lighting, it is only necessary to secure the snap buttons 44 on top of yard stakes 56 (FIG. 3) at spacing similar to that employed in FIG. 5.

FIG. 6 illustrates a storage rack 65 consisting of opposite end frames 66 and 68 as joined together by upper tube 70 and lower tube 72. The components of storage rack 65 are preferably formed from plastic as tubes 70 and 72 may be tubular stock of requisite length and the end frames 66 and 68 are injection molded utilizing a suitable plastic. The upper tube 70 also serves as a carrying handle during manual transport.

The end frame 66 includes opposite side risers 74 and 76 disposed in parallel and joined by a top brace 78 and a lower brace 80 which maintain the risers in parallel. A strengthening spar 82 is formed across the mid-point of risers 74 and 76. A cylindrical cup 84 is formed at a mid-point of upper brace 78 and oriented to receive tight insertion of upper tube 70. Similarly, a cylindrical cup 86 is formed at a mid-point of lower brace 80 to receive lower tube 72 firmly therein. Similar configuration is found on the opposite side end frame 68 which is formed with opposite risers 88 and 90 connected by upper brace 92 and cylindrical cup 94, and lower brace 96 which includes cylindrical cup 98. Then, in similar manner, the upper tube 70 is firmly received within cup 94 while the lower tube 72 is secured into cup 98.

The outer side 100 of riser 74 is formed with a plurality of pairs of opposed cleats 102 and 104, and each of the opposed cleats includes an oppositely oriented flange 106 and 108, respectively, which function to provide gripping surfaces to receive the track channels for storage, as will be further described below. An equal plurality of cleat pairs 102 and 104 having oppositely oriented flanges 106 and 108 are also formed along the outside surface of riser 76.

The opposite end frame 68 is similarly formed with the outside surface 110 of riser 90 formed to include a plurality of pairs of cleats 112 and 114 having respective opposed flanges 116 and 118. The outside surface of riser 88 also includes a plurality of the paired cleats 112 and 114 having opposed flanges 116 and 118, respectively, and a strengthening spar 120 is formed across the mid-point between risers 88 and 90.

Figure 7A:
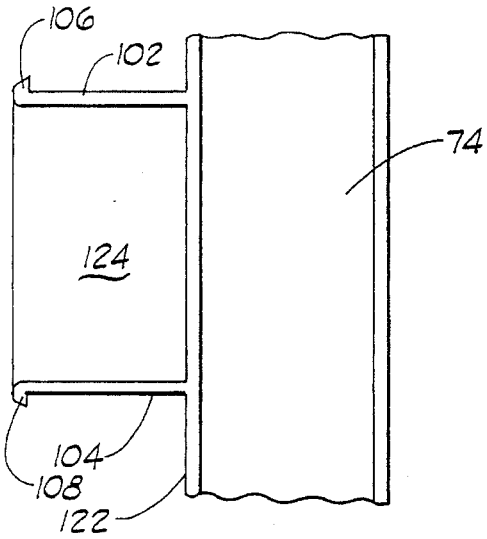
FIG. 7A is a side view of a sector of riser from an end frame as shown in FIG. 6.
Figure 7B:
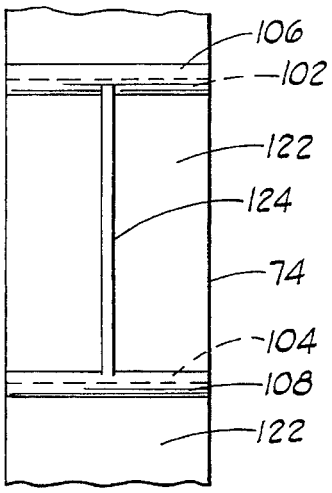
FIG. 7B is an end view of the sector of FIG. 7A.

FIGS. 7A and 7B illustrate the cleat structure with greater clarity. Thus, referring to FIG. 7A, a portion of riser 74 is formed to have cleats 102 and 104 formed integrally on the side 122. Each of the cleats 102 and 104 is formed with a respective opposite-extending flange 106 and 108 and a central strengthening vane 124 is mold-formed to extend between respective cleats 102 and 104 for longitudinal reinforcement. The side view of FIG. 7B illustrates the disposition of vane 124 as it extends between cleats 102 and 104. Similar structure is utilized at the opposite end frame 68 as reinforcing vane 126 extends in bisection between respective cleats 112 and 114.

Figure 8:
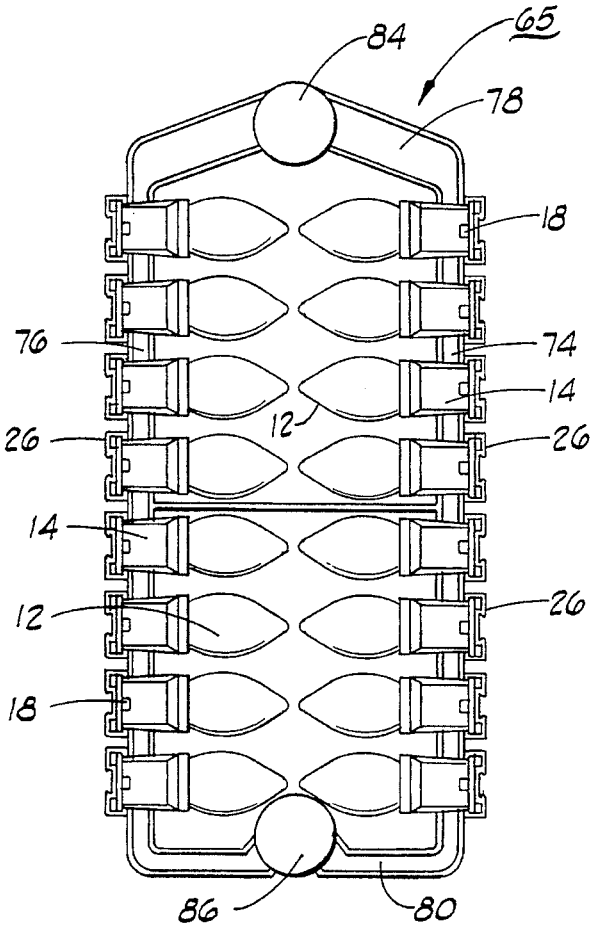
FIG. 8 is an end view of the storage rack of FIG. 6 when loaded with a full complement of light strings and track channels.

FIG. 8 provides an end view of a storage rack 65 which is fully loaded with a plurality of light strings as retained on track channels 26. Thus, in the case of a thirty-two light outdoor string as shown in FIG. 4 and supported on four six-foot track channels 26, the storage rack 65 could retain four such thirty-two light strings as supported on sixteen track channels 26, eight on each side. Thus, in each case, a single track channel 26 may be snapped onto respective opposite end pairs of cleats 102 and 104 and 112 and 114, the cleat pairs occupying similar positions on the opposite end frames 66 and 68. The fully loaded storage rack 65 may then be hand carried by means of top joinder tube 70 (FIG. 6) to a suitable storage location until next required usage.

In operation, stored light sections on storage rack 65 may be removed for snap-fit disposition on pre-arranged snap buttons 44 that have been previously secured to subtend the desired lighting array on rooftop, building facia or in yard stake array. If it is desired to change or alter the lighting arrangement it is only necessary to move the snap button 44 since the fasteners 50 may be re-secured at any desired position.

When the lighting system is to be taken down it is only necessary to unsnap each successive ones of the track channels 26 by removing the snap channel 38 from the associated snap button 44, and each successive track channel 26 may then be snapped onto paired cleat structure of the end frames 66 and 68 of the storage rack 65. When the full complement of track channels 26 is placed on storage rack 65, the rack 65 may be carried by means of top joinder tube 70 for placement in storage until next planned usage of the light system. The track mounted light strings may be divided up into any convenient number per track channel depending upon the overall number of lights. A normal or usual storage rack 65 may be assembled with the top and bottom tubes 70 and 72 being of 48 inch lengths which easily accommodate the multiple of six foot track sections of the type shown in FIGS. 4 and 5.

Figure 9C:
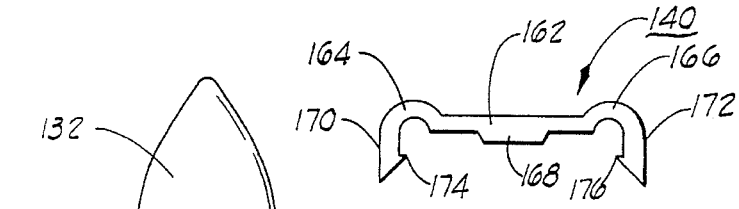
FIG. 9C is an enlarged transverse view in section of the universal clip of FIG. 9A.
Figure 9A:
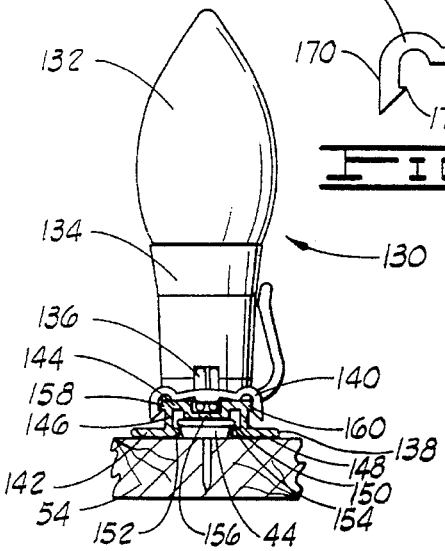
FIG. 9A is a side view in elevation with parts shown in section of an alternative form of Christmas light socket, track channel, and universal clip.
Figure 9B:
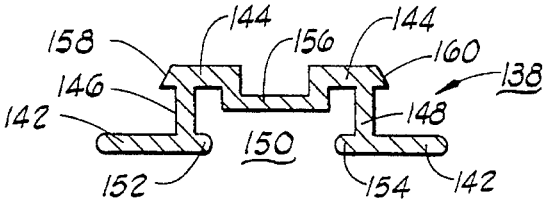
FIG. 9B is an enlarged transverse sectional view of the track channel of FIG. 9A.

Referring now to FIGS. 9A, 9B, 9C and 10, there is illustrated an alternate design that is capable of adapting to most existing standard outdoor light strings. A standard outdoor light string 130 having bulbs 132 of predetermined number with individual sockets 134 electrically connected in spaced disposition along a cable 136, either a two-wire pair or multi-conductor cable, is retained along a track channel 138 (FIG. 9B). The lengths of light string 130 are held in position in predetermined lengths of extruded track channel 138 by means of a plurality of universal clips 140 (FIG. 9C).

The track channel 138 may be extruded from suitable plastic or metal so long as it exhibits minimal resiliency. The track channel 138 consists of a bottom panel 142 and a top panel 144 which are rigidly attached by opposite side parallel walls 146 and 148. The bottom panel 142 includes a central channel 150 opening upward and defined on opposite side by interfering flanges 152 and 154. The central channel 150 serves for snap seizure on the snap buttons 44 as they are selectively positioned. The top panel 144 includes a central groove 156 along the length thereof, the groove 156 serving to retain the light cable 136 therein along its length. Laterally protruding flanges 158 and 160 extend outward on each side of top panel 144 for gripping purposes, as will be further described below.

Figure 10:
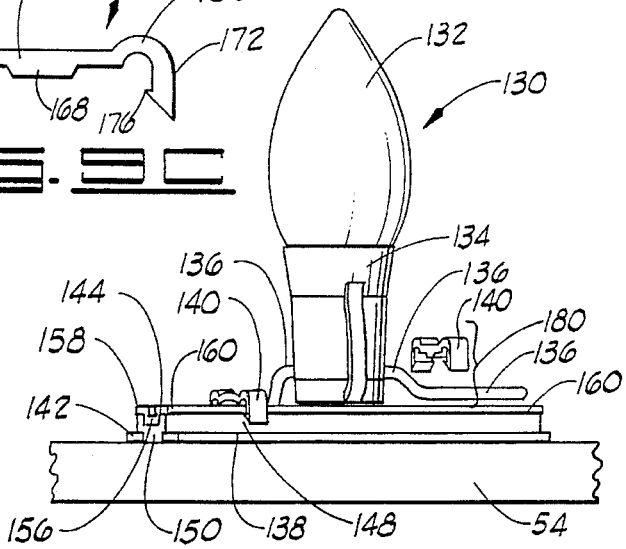
FIG. 10 is a view in side elevation of the FIG. 9 items when assembled into operative position.

The universal clips 140 may be extruded in lengths and then sliced into relatively thin strips, as shown in FIG. 10. Universal clip 140 is formed to have an elongate central panel 162 (FIG. 9C) with opposite side, parallel yoke formations 164 and 166 formed on the ends. A central protrusion 168 is formed to extend along the bottom of center panel 162, and this serves primarily for maintaining pressure against the cable 136 running within the central groove 156. The opposite side yokes 164 and 166 are each formed semi-circularly to extend opposite side outer tines 170 and 172 in a generally vertical plane while each includes a respective inner flange 174 and 176 for gripping purposes.

Referring primarily to FIG. 10, the light fixtures 130 of nearly all pre-existing types of Christmas light string as well as other serial light strings are compatible for use with the track channels 138 and a plurality of universal clips 140. As the electric cable 136 is laid down in the elongate groove 156 of the track channel 138, each of a pair of universal clips 140 is secured closely on each side of each individual light socket 134 thereby to position and retain the electric cable 136 within groove 156 while also serving to prevent rotation of the socket 134 when replacing lamps or such. The universal clip 140 simply clamps down over the upper panel 144 of track channel 138 as respective yoke arms 164 and 166 snap over the edges of upper panel 144 and the tine flanges 174 and 176 clip beneath the outer flanges 158 and 160 of upper panel 144. An exploded form 180 of the universal clip fixture 180 is shown in FIG. 10.

Figure 11:
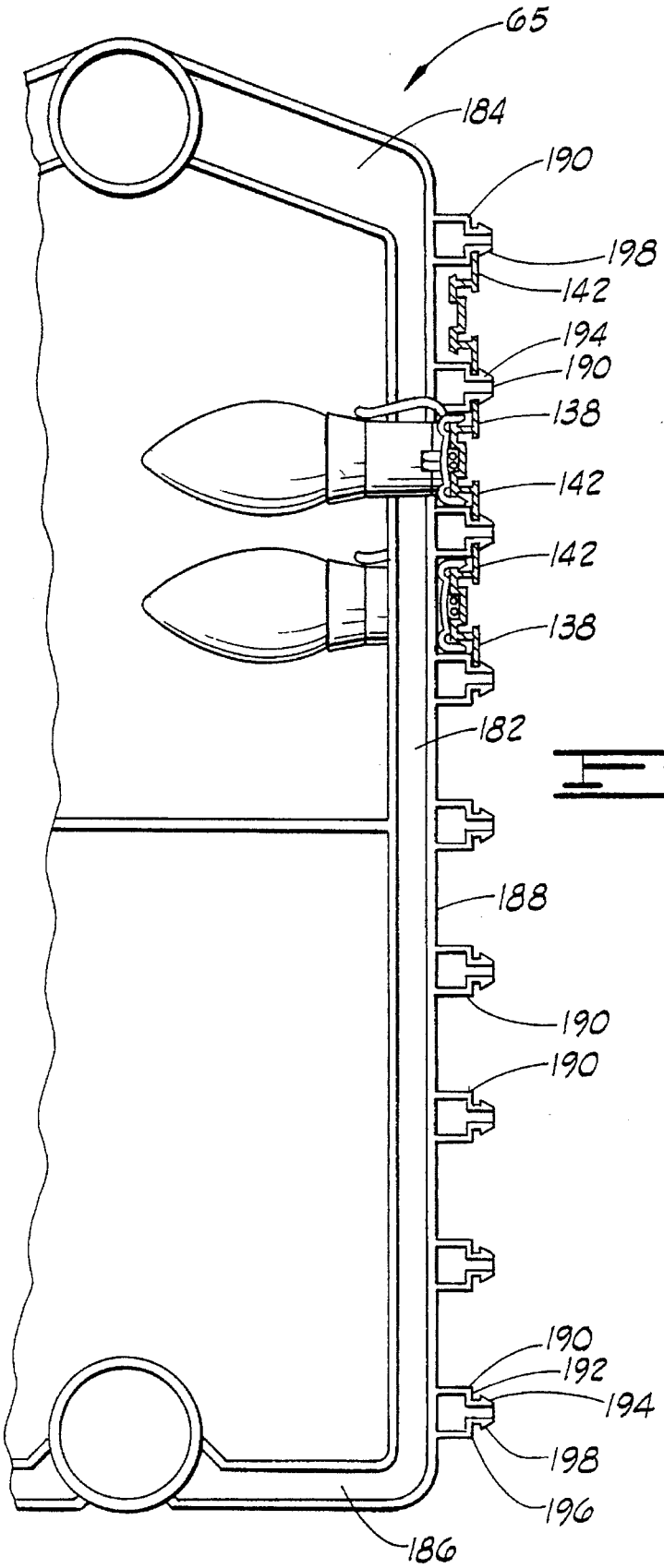
FIG. 11 is a partial end view of an alternative form of storage rack end frame.

Referring now to FIG. 11, the track channels 138 are also adaptable to storage and transportation on storage racks 65. The only change necessary to storage rack 65 is a change to the cleat structure along the outside edges of the opposite end frames. A representative showing in FIG. 11 discloses an end frame riser 182 connected by top brace 184 and bottom brace 186 wherein the outer vertical edge 188 is formed with a plurality of lugs 190. Each of the lugs 190 is formed with a shoulder 192 and flange 194 and, in mirror-image, a shoulder 196, and flange 198 so that between each successive pair of lugs 190 a track channel 138 may be snapped therein for secure affixture. In each case, the bottom panel 142 of the track channel snaps into position between adjacent lugs 190, and a series of light strips each securely mounted on individual track channels 138 may be snapped onto storage rack 65 for transportation and storage.

Figure 12:
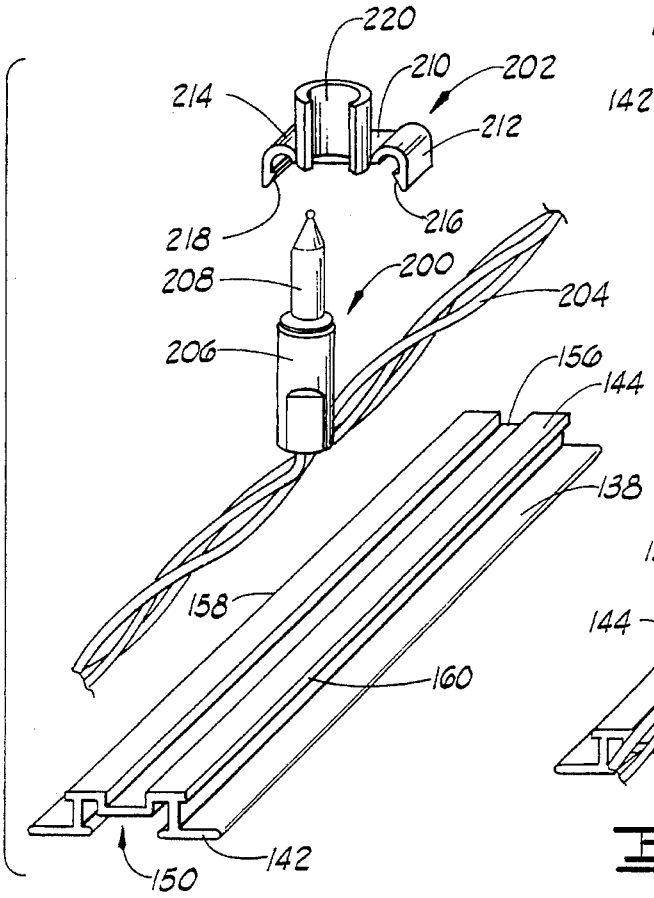
FIG. 12 is a perspective view in exploded form of yet another alternative track channel, light string and snap fastener.
Figure 13:
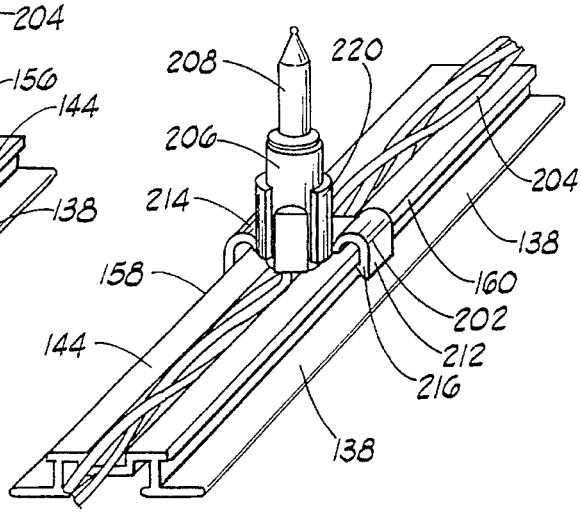
FIG. 13 is a perspective view of the FIG. 12 elements when assembled into operative position.

Recently, the prior U.S.-type light strings have been replaced at an increasing rate by oriental-type miniature light strings which are now so prevalent. FIGS. 12 and 13 illustrate the manner in which the same alternative form of track channel 138 may contain a miniature light string 200 with a multiple of sockets 206 by using an adaptor clip 202. The light string 200 includes an electric cable 204, usually multi-conductor, which is adaptable to lie down within the elongate groove 156 in upper panel 144 of track channel 138. Each of lamp sockets 206 carrying lamp bulbs 208 is then secured in position with an adaptor clip 202 while the cable 204 is clipped securely into track channel 138.

The adaptor clip 202 is a molded plastic item that includes the essential structure of universal clip 140 with a transverse central panel 210 having arcuate tines 212 and 214 formed on each side and terminating in respective inwardly directed flanges 216 and 218. A resilient, circular clip 220 is integrally formed at right angle to the transverse central panel 210. The circular clip 220 merely snaps around a lamp socket 206 so that the clip adaptor 202 may be snap-fit onto the top panel 144 of track channel 138 to maintain the electric cable 204 down within the groove 156. Thus, a clip adaptor 202 is utilized with each lamp socket 206 along each segment of electric cable 204 as retained by each length of track channel 138.

The lengths of track channel 138 are then readily compatible for storage in a storage rack 65. That is, each track channel 138 having bottom panel 142 will snap fit between a respective pair of lugs 190 in storage rack 65 (FIG. 11). As is characteristic of the miniature lights 200, they are very closely spaced along the length of the electric cable 204 such that a full complement of track channels 138 assemble to contain successive lengths of miniature light string 200 thereby to enable a great multitude of individual lights to be carried on the storage rack 65. For example, referring to FIG. 11, with both sides of storage rack 65 filled, i.e., eight lengths of track channel 138 carried on each side of the storage rack, there would be as much as ninety-six feet of individual light segments. Such light strings may be continuous or they may be segmented and connected in succession.

The foregoing discloses a novel scheme for pre-arranged Christmas lighting utilizing a multiple of track channel sections containing successive lengths of lighting string. The track channels support the lighting strings on the storage rack 65 and they also maintain the respective wire-string male and female plugs accessible so that lights can be pre-tested while disposed on storage rack 65 and before final snap-fit placement of the light strings along their pre-arranged dispositions. Thus, the storage rack enables transport and storage of a relatively large number of lights on one or more light strings, the entire storage rack and light string assembly being light in weight and of a size that is not unwieldy.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A light track installation system, comprising:

at least one extruded track channel of selected length, said track channel having a base, opposite side tines disposed upward and in parallel, and a central snap channel formed in said base and opening downward;

an electrical supply cord disposed along said track channel;

a plurality of spaced lamp sockets electrically connected to said electrical supply cord and each secured in snap-fit between the opposite side tines of said track channel; and plural snap buttons mounted along a selected site to receive said track channel central snap channel in secure affixture thereby to support the electrical supply cord and spaced lamp sockets at the selected site.

2. A light track installation system as set forth in claim 1 wherein:

said selected site is on a building structure; and said snap buttons are molded with a central hole for nail fastening to the structure.

3. A light track installation system as set forth in claim 1 wherein:

said selected site consists of at least two spaced yard stakes, each having a snap button secured thereon.

4. A light track installation system as set forth in claim 1 which further includes storage structure comprising:

first and second end frames each having opposite side rails, bottom rail and top rail, said opposite side rails each having plural lug pairs formed in equal spacing along the outer side;

a lower support tube secured between the bottom rails of the first and second end frames; and an upper support tube secured between the top rails of the first and second end frames;

whereby at least one extruded track channel with electrical supply cord and lamp sockets affixed thereon can be secured on said storage structure by snap-fitting the track channel opposite side tines onto respective lug pairs of the first and second end frames.

5. A light track installation system as set forth in claim 4 wherein:

a plurality of track channels with electrical supply cord and lamp sockets are secured in parallel on respective lug pairs on the side rails of the first and second end frames.

6. A light track installation system as set forth in claim 1 wherein:

said track channel opposite side tines are formed as opposite side rails having an inwardly formed flange along their length; and said spaced lamp sockets are each formed with a protruding base flange for retention between opposite side rail and flanges.

7. A light track installation system as set forth in claim 1 which further comprises:

a plurality of said track channels each having electrical cord with spaced lamp sockets snap-fit thereon; and a plurality of pairs of snap buttons securely mounted along said selected site.

8. A light track installation system as set forth in claim 1 wherein said at least one extruded track channel comprises:

opposite side rails extending perpendicularly and in parallel from each side of said base, said side rails each terminating with a respective inward extending flange; and said central snap channel being formed longitudinally and centrally in said base with narrowing beads formed on each side of said channel adjacent the base.

9. A transport and storage apparatus for a multi-track Christmas light assembly, comprising:

a plurality of track channels of selected length, each track channel having opposite side tines;

a multiple light string having spaced bulbs retained on said plural track channels;

first and second end frames each having opposite side rails disposed in parallel and being interconnected by respective first and second bottom rails and top rails;

at least one support tube connecting said first and second end frames; and plural lug pairs disposed in equal spacing along said opposite side rails of said first and second end frames so that each track channel can be snap-fit and supported on a respective pair of first end lug pairs and second end lug pairs.

10. A transport and storage apparatus as set forth in claim 9 wherein said at least one support tube comprises:

an upper support tube connected centrally between said first and second top rails; and a lower support tube connected centrally between said first and second bottom rails.

11. A light track installation system, comprising:

at least one extruded track channel of selected length, said track channel being formed to have a top panel and a bottom panel secured in parallel by interconnection of opposite side parallel walls, said top panel including an elongate central groove, and said bottom panel having an elongate central snap channel extending therealong;

an electrical supply cord disposed adjacent said track channel top panel;

a plurality of spaced lamp sockets electrically connected along said electrical supply cord;

a plurality of universal clips, each having a central portion disposed transverse of said track channel top panel and depressing said supply cord into said top panel central groove, said clips having opposite side tines for snap-fit onto the track channel top panel, said universal clips being disposed on each side of each lamp socket; and plural snap buttons mounted along a selected site to receive said track channel central snap channel in secure fixture to support the light system.

12. A light track installation system as set forth in claim 11 wherein said universal clips each further comprise:

a transverse central panel formed on each side into an arcuate yoke, each side yoke terminating in a downward oriented tine having an inward flange.

13. A light track installation system as set forth in claim 11 wherein:

said track channel bottom panel is wider than said track channel top panel; and said central snap channel is wider than said top panel groove.

14. A light track installation system as set forth in claim 11 which further includes storage and transportation structure comprising:

first and second end frames each having opposite side rails, bottom rail and top rail, said opposite side rails each having plural lug pairs formed in equal spacing along the outer side;

a lower support tube secured between the bottom rails of the first and second end frames; and an upper support tube secured between the top rails of the first and second end frames;

whereby at least one extruded track channel with a length of electrical supply cord and lamp sockets affixed thereon can be secured on said storage and transportation structure by snap-fitting the track channel bottom panel between respective lug pairs of the first and second end frames.

15. A light track installation system as set forth in claim 14 wherein:

a plurality of track channels with electrical supply cord and lamp sockets are secured in parallel disposition on said respective lug pairs on the side rails of the first and second end frames.

16. A light track installation system as set forth in claim 11 which further comprises:

a plurality of said track channels each having electrical cord with spaced lamp sockets retained thereon; and a plurality of pairs of snap buttons securely mounted along said selected site.

17. Apparatus for retaining an electrical cord with spaced lamps in operative disposition, comprising:

an extruded track channel of selected length, said track channel being formed to have a top panel and a bottom panel joined in parallel by interconnection of opposite side parallel walls, said top panel including an elongate central groove, and said bottom panel having an elongate central snap channel extending therealong; and means for securing the electrical cord and spaced lamps along the top panel central groove.

18. Apparatus as set forth in claim 17 wherein said means for securing comprises:

a plurality of clip means each having a central panel extending into opposite yoke portions which terminate in downward directed tines, said plurality of clip means each being snap-fit over said track channel top panel at spaced locations to secure the electrical cord in the central groove.

19. Apparatus as set forth in claim 17 wherein said means for securing comprises:

a plurality of clip means each having a central panel extending into opposite yoke portions which terminate in downward directed tines, said plurality of clip means each being snap-fit over said track channel top panel at lamp locations to secure the electrical cord in the central groove; and a plurality of resilient cylindrical clips formed to extend generally perpendicular from said clip means central panel to secure each of said spaced lamps.

20. Apparatus as set forth in claim 17 which further includes:

means for storing a plurality of extruded track channels in parallel with said electrical cord and spaced lamps secured on each of said track channels.

* * * * *